United States Patent [19]

Howard, Jr.

[11] Patent Number: 4,518,891

[45] Date of Patent: May 21, 1985

[54] RESISTIVE MESH STRUCTURE FOR ELECTROLUMINESCENT CELL

[75] Inventor: Webster E. Howard, Jr., Yorktown Hgts., N.Y.

[73] Assignee: International Business Machines Corporation, Armonk, N.Y.

[21] Appl. No.: 336,483

[22] Filed: Dec. 31, 1981

[51] Int. Cl.[3] ..... H01J 31/10; H01J 29/28; H01J 1/70

[52] U.S. Cl. ..... 313/398; 313/463; 313/509

[58] Field of Search ..... 313/391, 397, 398, 395, 313/463, 505, 506, 509

[56] References Cited

U.S. PATENT DOCUMENTS

| | | | |
|---|---|---|---|
| 2,239,887 | 4/1941 | Ferrant . | |
| 2,880,346 | 3/1959 | Nicoll et al. . | |
| 3,075,122 | 1/1963 | Lehmann | 313/505 X |
| 3,346,757 | 10/1967 | Dierssen | 313/509 |
| 3,346,758 | 10/1967 | Dell | 313/509 |
| 3,644,741 | 2/1972 | Ovshinsky | 250/213 R |
| 4,207,617 | 6/1980 | Yasuda et al. | 365/111 |
| 4,369,393 | 1/1983 | Frame | 313/506 |

FOREIGN PATENT DOCUMENTS

| | | |
|---|---|---|
| 2050777 | 1/1981 | United Kingdom . |
| 1600545 | 10/1981 | United Kingdom . |

OTHER PUBLICATIONS

Howard, "Thin-Film Electroluminescent & Storage CRT", Mar. 1977, IBM Technical Disclosure Bulletin.

*Primary Examiner*—Palmer Demeo
*Assistant Examiner*—Sandra L. O'Shea
*Attorney, Agent, or Firm*—David D. Bahler; G. E. Clark; J. Jancin, Jr.

[57] ABSTRACT

A large-area electroluminescent (EL) faceplate for storage CRT is described. The EL faceplate has a non-planar mesh structure which includes individual current limiting resistance between a power source and an array of small-area active regions for improving the faceplate breakdown characteristics. The mesh, which comprises high conductivity strips and delivers power to the active regions, is substantially reduced in area relative to a simple conventional device, and is disposed on thick dielectric nonactive regions to further reduce the possibility of catastrophic breakdown.

14 Claims, 4 Drawing Figures

RESISTIVE MESH STRUCTURE FOR ELECTROLUMINESCENT CELL

DESCRIPTION

1. Technical Field

This invention relates generally to an electroluminescent storage CRT, and more particularly to a structure for improving the breakdown characteristics of a large-area thin film electroluminescent device.

2. Background Art

Thin film zinc-sulfide (ZnS) electroluminescent (EL) devices have in recent years been reported widely as promising for display applications. Of particular interest has been the observed inherent hysteretic behavior of such thin film ZnS devices, and its potential in large area storage CRT display applications.

An EL display panel which incorporates an electroluminescent device using a ZnS layer, for instance, is described in U.S. Pat. No. 4,207,617, issued to S. Yasuda et al. More particularly, the described EL panel has a ZnS layer confined between a transparent conductor and a rear electrode. Further, the ZnS layer is insulated from the transparent conductor and the electrode by a first and second dielectric layers. According to the invention, an electron beam is applied to a desired position on the EL display panel through the rear electrode at a time when the sustaining voltage signal nears the zero level in order to erase the memorized information. The memorized display information is electrically read out by detecting a polarization relaxation current which flows through a memorized display position when an electron beam is applied thereto.

Notwithstanding the attractive promise and advances made in recent years in EL storage CRTs, several critical issues are encountered in large-area storage CRT realization, and are still remaining. The term large-area as used in this context, and hereinafter, refers to a large EL panel having a size on the order of 1000 square cm. Several considerations arise in the design of large-area EL panels, and there are significant constraints associated with the manufacturing of large-area EL storage CRTs. Of particular importance are the problems of stability, multilayer material uniformity and reproducibility, as well as electrical breakdown associated with defects of the thin dielectric layers of the multilayered EL devices. The latter electrical breakdown problem is especially acute with EL panels having a large area. As is well known, the EL faceplate is essentially a thin film capacitor and is subjected to very high electric fields. This electrical breakdown problem is exacerbated by the large amount of energy stored in EL faceplates having a large area or operating at high potentials.

In early electroluminescent devices, it was recognized that a series resistance would be necessary to prevent the problem of phosphor breakdown. For instance, U.S. Pat. No. 2,880,346 describes an electroluminescent device having a planar structure including a resistive film layer. As another illustration of an electroluminescent device including a resistive layer, U.S. Pat. No. 3,068,755 also describes a phosphor EL device utilizing a resistive film layer. It should be noted that both of these devices as described are of the direct current type, and both have a planar structure.

Still another prior luminescent screen which includes a resistive layer is described in U.S. Pat. No. 2,239,887. According to the invention, a high resistive layer is incorporated in the luminescent phosphor device structure to allow only a very slow charge up.

A prior electroluminescent device having a non-planar device structure is described in U.S. Pat. No. 3,075,122. The patented invention includes a non-linear resistive layer. However, the described non-linear resistive layer is utilized for enhancements of contrast only.

Yet another electroluminescent display screen employing a resistive layer is described in U.S. Pat. No. 3,644,741 issued to Ovshinsky. According to this patent, the resistive layer is a variable resistance memory semiconductor material. Furthermore, the layer of memory semiconductor material has discrete portions which are individually alterable between stable high and low resistance conditions by application of predetermined amounts of energy to form the desired visible light patterns on the display screen.

As noted hereinabove, the problems of electrical breakdown of large-area EL devices are recognized. For instance, in an article entitled, "Device Characterization of an Electron Beam Switched Thin Film ZnS:Mn Electroluminescent Faceplate", by Omesh Sahni, et al, pages 708–719, IEEE Transaction on Electron Devices, Vol. Ed-28 No. 6, June 1981, the problems of electrical breakdown are described and characterized in some detail.

On page 715 of the same article, techniques for exploiting the phenomenon of non-shorting or self-healing breakdowns are described. According to the cited article, conditions which favor non-shorting breakdowns are a thin top electrode and a high source impedance. The top electrode must be thin so as to allow it to evaporate or melt back rapidly beyond the edge of a dielectric crater. If the top electrode remains in contact with the edge of the dielectric, a second or continuing breakdown may occur through the weakened area at the edge of the crater. A high source impedance permits the voltage across the capacitor to drop sufficiently during the event to terminate the breakdown process. In contrast, a low source impedance and a thick top electrode encourage continuation of the breakdown process in a lateral direction resulting in a propagating breakdown, a loss of large area, and possibly a shorted EL device.

SUMMARY OF THE INVENTION

It is a principal object of the present invention to provide an electroluminescent device structure suitable for making a large-area faceplate for EL storage CRT.

It is another principal object of the present invention to provide an EL device structure which alleviates the electrical breakdown problems associated with the large amount of energy stored in a large-area EL faceplate.

It is also an object of the present invention to provide an EL device structure for alleviating the problem of propagating electrical breakdown of EL devices.

It is generally an object of the present invention to provide an improved EL storage CRT.

These and other objects of the present invention are achieved by providing an electroluminescent (EL) storage CRT device with an EL faceplate and means for activating said faceplate, wherein said faceplate includes an array of EL cells, and wherein each of said EL cells includes an active luminescent layer confined between a transparent conductor and a second conductive layer, and said active luminescent layer being insulated from said transparent conductor and said second conductive layer by a first and second dielectric layers, and having the improvement including said second dielectric layer having a non-active region which surrounds the periphery of an active region of each of said EL cell; said non-active region of said second dielectric layer being about several times thicker than said active region of said dielectric layer, thereby ensuring activation of each of said EL cells by said activating means in said active regions only; and said second conductive layer having a high resistivity region overlaying at least said active region of said second dielectric layer, and a contiguous high conductivity region substantially overlaying said non-active region of said second dielectric layer in each of said EL cells, whereby a breakdown of said dielectric layers in an active region of any given EL cell causes a voltage drop across said high resistivity region to limit the current flow from said high conductivity region of said second conductive layer into said given EL cell, thus preventing a propagating breakdown of said electroluminescent faceplate.

The nature, principle and utility of the present invention will be better understood from the hereinafter detailed description of the invention when read in conjunction with the accompanying drawings.

BRIEF DESCRIPTION OF THE DRAWINGS

Details of the invention will be described in connection with the accompanying drawings, in which:

FIGS 3.1 and 3.2 are top views of the faceplate depicted in FIGS. 1 and 2 showing two examples of possible EL cell patterns.

DESCRIPTION OF THE PREFERRED EMBODIMENTS

Figure 1:
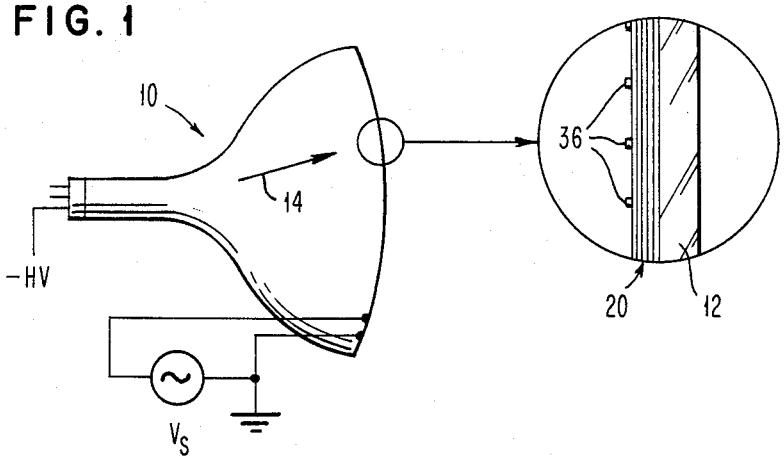
FIG. 1 is an electroluminescent storage CRT including an EL faceplate in accordance with the teaching of the present invention.

Referring to FIG. 1, an electroluminescent (EL) storage CRT 10 is shown to include an EL faceplate 20 positioned on the front glass plate 12 of the EL storage CRT 10. A light pulse, or a pulse of high energy electrons 14 powered by a high voltage source −HV may be used to switch the luminance level of an area at the EL faceplate 20. An alternating current source Vs is applied to the EL faceplate 20 to maintain the luminance level by charging the EL faceplate 20 alternately to positive and negative potentials.

For many CRT display applications, the EL faceplate 20 is often required to have an area typically on the order of 1000 square cms. or larger. As is well known, an EL faceplate has an equivalent circuit of a thin film capacitor and is subjected to very high electric fields, i.e., on the order of $10^6$ volts/cm. As such, EL panels quite often are susceptible to electrical breakdown. Indeed, it is necessary for luminescence that the active layer 22 breaks down while the dielectric layers must remain insulating. Unfortunately, such EL panels are prone to electrical breakdown associated with defects of the thin dielectric layers of the conventional multilayered EL structure.

Accordingly, the problem of electrical breakdown of conventional thin film EL device structure is well recognized. In particular, the electrical breakdown problem tends to be catastrophic in large-area devices because the large amount of energy stored in the large-area faceplate can be dissipated in a small area of the EL device, with intense local heating. More specifically, in a conventional EL device structure, the aluminum layer and the transparent conductor constitute the plates of the capacitor. When a breakdown event occurs at some point, all of stored energy on the conductors can be dissipated rapidly. Since there is no significant limitation to lateral current flow, large current density with intense local heating may result. Such a local breakdown may give rise to loss of a large area by way of a propagating breakdown to adjacent area, or alternatively such an event may result in a shorted EL device.

Figure 2:
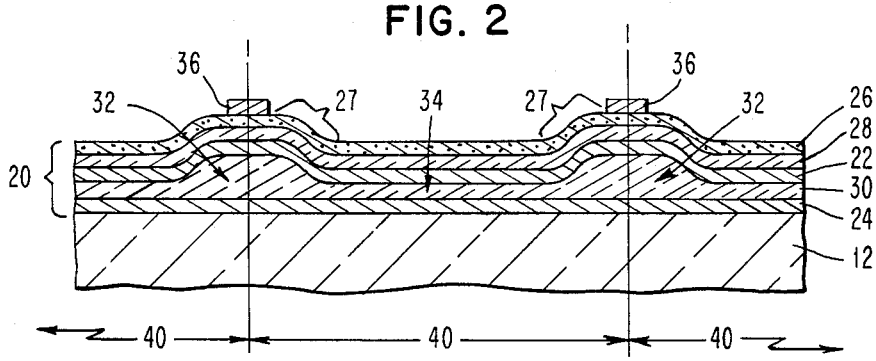
FIG. 2 is an expanded cross-sectional view of the EL faceplate depicted in FIG. 1 showing the device structure.
Figure 2:
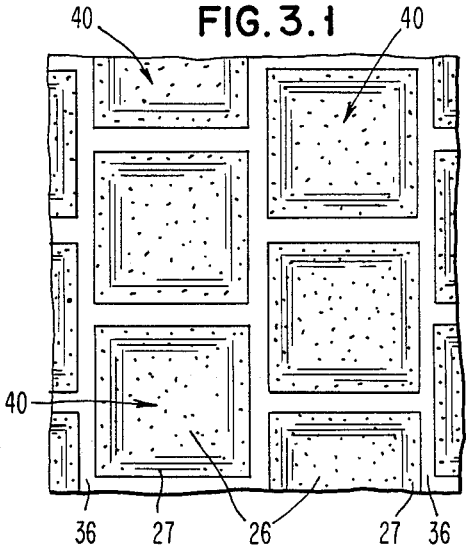
Figure 2:
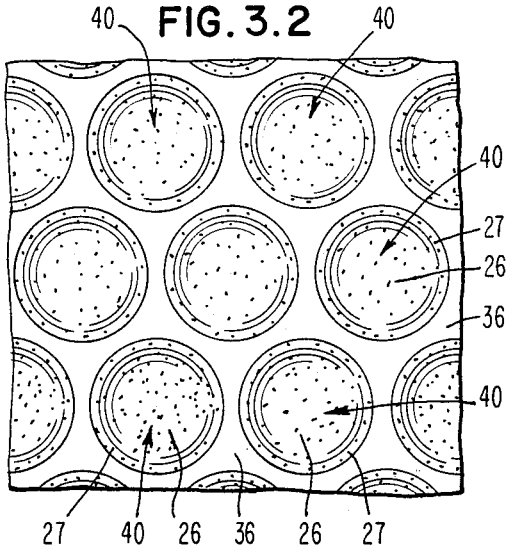

The EL faceplate 20 according to the present invention has a mesh structure as shown in both FIG. 2, which provides a cross-sectional view, and FIG. 3.1, which provides a top view of the faceplate 20.

Referring to FIG. 2, the multilayered EL faceplate 20 according to the present invention includes an array of EL cells 40 (FIGS. 3.1 and 3.2). Each of the EL cells 40 comprises an active luminescent layer 22, such as ZnS:Mn, confined between a transparent conductor 24 and a resistive layer 26; and the active luminescent layer 22 being insulated from the transparent conductor 24 and the resistive layer 26 by a first dielectric layer 28 and a second dielectric layer 30.

The dielectric layer 30 has a non-active, narrow region 32, about several microns wide, which surrounds the periphery of an active region 34, which region is on the order of 70 microns wide. The active region 34 of the dielectric layer is approximately 0.5 micron thick while the non-active region 32 thickness is about several times that of the active region 34. Amorphous $BaTiO_3$ and other suitable high strength dielectric materials may be used to form dielectric layers 28 and 30.

Overlaying the non-active, narrow region 32 are interconnected high conductivity strips 36, such as aluminum, which are positioned also to contact the resistive layer 26. As is required for proper device operation in a conventional EL faceplate, the high conductivity mesh, formed by interconnecting the strips 36, and transparent conductor 24, are connected to the alternating current voltage source Vs. Thus, in the arrangement according to the present invention, A1 strips 36 forming the mesh together with resistive layer 26 forms one plate, and transparent conductor 24 forms the other plate of the EL faceplate 20 capacitor. Accordingly, it should be noted that the EL faceplate 20 capacitor according to the present invention has a nonplanar mesh structure wherein the dielectric layer 30 thickness in the narrow region 32 is about several times that in the active region 34.

According to the present invention, the resistive layer 26 is used to contact the active regions 34, wherein high electric fields, on the order of $10^6$ V/cm, are experienced and wherein breakdowns of the thin dielectric layers within said active regions 34 are most likely to occur. In this arrangement, the thicker dielectric region 32 ensures that each EL cell 40 is activated by the alternating voltage source Vs only within the active region 34.

According to the non-planar mesh structure of the present invention, each EL cell 40 is provided with a current limiting resistance formed substantially by the resistive layer 26 in side areas 27. In the event of an electrical breakdown due to dielectric defects at some point within the active region 34, any current flow between the transparent conductor 24 and the high conductivity strips 36 must travel through the current limiting resistance, and thereby developing a voltage drop thereacross. This tends to limit a build-up of large current density and thus avoids a catastrophic breakdown, with intense local heating.

The sheet resistivity of the resistive layer 26 is also selected to be sufficiently high so that any shorting due to dielectric defects in the active region 34 will only result in heating of the resistive layer 26, and heat dissipation into the substrate and the front glass plate 12 will ensure that the heating is maintained at an acceptable level, i.e., at about 50° C. It is also important that the voltage drop across the resistive layer 26 within a given active region 34 not be too large for the case when only normal AC current flows. For the embodiment described herein, it is preferable that this voltage drop be less than about 1 volt so as to maintain uniform luminance across the EL cell 40.

For the preferred embodiment described hereinabove, the aforestated two requirements can, in fact, be met nicely by having the sheet resistivity of the resistive layer 26 to be selected at a value on the order of $5\times10^7$ ohms per square. Such resistive layer 26 can be made of cermets, which are metal-oxide composites, or amorphous semiconductor, such as $\alpha$-Si:H, or other suitable materials.

In summary, an EL panel or faceplate having a device structure according to the teaching of the present invention includes current limiting resistance between the power source Vs and an array of small-area active regions 40. In this non-planar device structure, the high conductivity mesh comprising said strips 36, which distributes power to the active regions 40 is substantially reduced in area relative to a simple conventional device, and is disposed on a thick dielectric layer to reduce the possibility of catastrophic breakdown under the conductor.

A further benefit of this structure is that resistive materials such as Ni-$SiO_2$ cermets or $\alpha$-Si:H, may be black. The resistive layer 26 therefore, may serve also to enhance the visible contrast of the EL storage CRT 10. While A1 strips 36 and high resistivity layer 26 are shown and described to be separate and distinct layers, this clearly need not be the case. Other embodiments are possible for instance, A1 strips 36 and high resistivity layer 26 may be substituted by a single conductive layer having both a high resistivity region overlaying at least said active region 34 and a contiguous high conductivity region substantially overlaying said non-active region 32 of each of said EL cells 40.

Although the mesh structure as illustrated in FIG. 3.1 is such as to give rise to an active area 40 having a square shape, other mesh structures and patterns are also possible. As another illustration, FIG. 3.2 shows a mesh structure resulting in an active area having a circular shape. Furthermore, the dimensions are given illustratively and are chosen primarily to ensure that the structure will not seriously degrade resolution. More specifically, a 250 micrometer diameter beam 14 in the present preferred embodiment will cover several active regions 40.

While a thin resistive layer 26 is used in the preferred embodiment as described hereinabove, if the sheet resistivity is obtained by using a moderately thick layer with rather high bulk resistivity, then the EL device structure according to the teaching of the present invention will also provide current limiting action with respect to breakdown under the metallic mesh as well. The limiting consideration here is that a light beam or an electron beam 14 used to switch the devices must penetrate a thicker resistive layer 26 in order to reach the active regions 40 of the EL faceplate 20.

From the preceding detailed description of applicant's invention, an electroluminescent storage CRT having a large-area EL faceplate according to the teaching of the present invention has advantages which heretofore have not been possible to achieve. In addition to the variations and modifications to applicant's disclosed apparatus which have been suggested, many other variations and modifications will be apparent to those skilled in the art, and accordingly the scope of applicant's invention is not to be construed to be limited to the particular embodiments shown or suggested.

Having thus described my invention, what I claim as new, and desire to secure by Letters Patent is:

1. An array of electroluminescent cells for displaying data wherein each said electroluminescent (EL) cell includes a transparent conductor, a first insulator layer thereon, a layer of luminescent material on said first insulator layer, a second insulator layer applied to said luminescent material layer, a second conductive layer applied to said second insulator layer, said EL cell having the improvement comprising:

each said EL cell having a substantially planar first region substantially parallel to said transparent conductor wherein luminance level is alterable, and a second region surrounding and substantially coplanar with said first region, said second region being nonluminous; and said luminescent material layer being continuous across said first and second regions; and said second conductive layer having a predetermined resistivity overlaying said second insulator layer to reduce damage to said luminescent layer due to defects in said EL cell structure.

2. An electroluminescence cell according to claim 1 wherein said first region of each cell is separated from a first region of adjacent cells by a second region of each cell, said second region having a thickness of said second insulator layer which is several times a thickness of said second insulator layer in said first region to improve electrical separation between EL cells in said array and to limit damage due to defects in said cell.

3. In an EL cell as set forth in claim 2 wherein said second conductive layer includes a high resistivity layer overlaying said EL cell, and a high conductivity layer overlaying said second region and making contact to said high resistivity layer.

4. In an EL cell as set forth in claim 3 wherein said luminescent layer is ZnS:Mn.

5. In an EL cell as set forth in claim 4 wherein said high resistivity layer has a resistivity on the order of $5\times10^7$ ohms per square, and said high conductivity layer is aluminum.

6. In an EL cell as set forth in claim 5 wherein said high resistivity layer is made of cermets.

7. In an EL cell as set forth in claim 5 wherein said high resistivity layer is made of amorphous semiconductor such as $\alpha$-Si:H.

8. An electroluminescent faceplate having an array of electroluminescent cells for displaying data wherein each said electroluminescent (EL) cell includes a transparent conductor, a first insulating layer thereon, a layer of luminescent material on said first insulator layer, a second insulator layer applied to said luminescent material layer, a second conductive layer applied to said second insulator layer, said EL cell having the improvement comprising:

each said EL cell having a substantially planar first region substantially parallel to said transparent conductor wherein luminance level is alterable, and a second region surrounding and substantially coplanar with said first region, said second region being nonluminous; and said luminescent material layer being continuous across said first and second regions; and said second conductive layer having a predetermined resistivity overlaying said second insulator layer to reduce damage to the luminescent layer due to defects in said EL cell structure.

9. An electroluminescent (EL) cell according to claim 8 wherein first rergion of each cell is separated from a first region of adjacent cells by a second region of each cell, said second region having a thickness of said second insulator layer which is several times a thickness of said second insulator layer in said first region to improve electrical separation between EL cells in said array and to limit damage due to defects in said cell.

10. An EL faceplate as set forth in claim 9 wherein said second conductive layer includes: a high resistivity layer overlaying each of said EL cells, and a high conductivity layer substantially overlaying said second region of each cell and making contact to said high resistivity layer.

11. In an EL faceplate as set forth in claim 10 wherein said luminescent layer is ZnS:Mn.

12. In an EL faceplate as set forth in claim 11 wherein said high resistivity layer has a resistivity on the order of $5\times10^7$ ohms per square, and said high conductive layer is aluminum.

13. In EL faceplate as set forth in claim 12 wherein said high resistivity layer is made of cermets.

14. In an EL faceplate as set forth in claim 12 wherein said high resistivity layer is made of amorhpus semiconductor such as $\alpha$-Si:H.

* * * * *

UNITED STATES PATENT AND TRADEMARK OFFICE

CERTIFICATE OF CORRECTION

PATENT NO. : 4,518,891

DATED : May 21, 1985

INVENTOR(S) : Webster E. Howard, Jr.

It is certified that error appears in the above-identified patent and that said Letters Patent is hereby corrected as shown below:

Claim 9 - Col. 7, line 15 "rergion" should be --region--.

Claim 13 - Col. 8, line 15 After "In" insert --an--.

Signed and Sealed this

*Fifteenth* Day of *October 1985*

[SEAL]

*Attest:*

DONALD J. QUIGG

*Attesting Officer*

*Commissioner of Patents and Trademarks—Designate*